United States Patent [19]

Borows

[11] 4,411,369

[45] Oct. 25, 1983

[54] ONE WAY STOPPER PLUG FOR BOTTLES

[76] Inventor: Allan A. Borows, 1889 Palmer Ave., Larchmont, N.Y. 10538

[21] Appl. No.: 381,823

[22] Filed: May 25, 1982

[51] Int. Cl.[3] ..... B65D 49/02

[52] U.S. Cl. ..... 215/21; 215/26

[58] Field of Search ..... 215/21, 26, 29, 17

[56] References Cited

U.S. PATENT DOCUMENTS 4,043,473 8/1977 Webb ..... 215/21

4,217,988 8/1980 Mills et al. ..... 215/21

*Primary Examiner*—Donald F. Norton

*Attorney, Agent, or Firm*—H. Gibner Lehmann; K. Gibner Lehmann

[57] ABSTRACT

A one-way stopper plug for bottles and the like, comprises a one-piece resilient plastic molding consisting of two mating halves joined to each other by an integral living hinge whereby the entire unit can be molded in one operation. Each half has a semi-cylindrical wall and two transverse walls at its ends, said walls having planar edge portions adapted for co-engagement when the halves are folded together, thereby to form a complete cylinder. The living hinge connects two of the transverse walls together. The mating halves define a channel therethrough, and a back-check valve disposed in the assemblage operates to limit fluid flow in only one direction. Forcing the assembled halves into a bottle neck maintains them in their assembled relation.

9 Claims, 13 Drawing Figures

ONE WAY STOPPER PLUG FOR BOTTLES

No cross references to related applications.

BACKGROUND

This invention relates to devices for preventing the unauthorized refilling of bottles such as liquor bottles and the like, and more particularly to plug constructions adapted to be inserted in the necks of the bottles for this purpose.

In the past a number of one-way stopper plugs for bottles have been proposed and produced. Many of these have involved numerous parts or components, which had to be individually manufactured and then assembled. This was time-consuming and expensive, constituting a distinct drawback where the devices were often discarded after a single use. As a general rule, single-use items must be so constructed as to represent the ultimate in low cost. If not, they cut into the profits of an otherwise desirable product by constituting an unwarranted large fraction of the price paid by the consumer. Also, in connection with competitive items it is important to keep costs as low as possible so that competitors do not have an unduly great advantage, from the price standpoint.

In some cases prior devices of this type did not perform satisfactorily in that they interfered with the necessary flow of the liquid from the bottle, or else were not sufficiently tamper-proof whereby the bottle could be surreptitiously refilled with an inferior or cheaper grade of product. This could occur not only in commercial establishments but also in the case of private homes.

In present times which are characterized by very high labor costs, the circumstance of requiring assembly operations, perhaps involving semi-skilled help, becomes an important factor if the device is labor-intensive. In such case, the ultimate cost of an item can be prohibitive, and make the difference between a successful project and one that is destined to fail.

Also entering the picture is the matter of mold costs, where the device is to be fabricated of plastic substances. For the sake of economy of manufacture it is customary to go to multiple-cavity molds, which represent an appreciable expense. In the case where the mold configuration is complicated, or involves undercuts and other special shapes, the mold cost is corresponding further undesirably increased. Prior devices of complicated configuration therefore were subjected to disadvantages of this type, dealing with initial tooling costs.

The above drawbacks and disadvantages of prior back-check plugs for rendering bottles non-refillable are obviated by the present invention, and one object of the invention is to provide a novel and improved one-way stopper plug for bottles and the like, which is especially simple and low cost in its construction whereby it can constitute a throw-away item if necessary, without unnecessarily burdening the cost structure of the product with which it is to be used.

Another object of the invention is to provide an improved one-way stopper plug for bottles as above set forth, which has a configuration making for easy and quick molding in inexpensive cavities.

Still another object of the invention is to provide a novel and improved stopper plug for bottles as above characterized, which involves an absolute minimum of labor in its fabrication and use.

Yet another object of the invention is to provide an improved one-way stopper plug for bottles in accordance with the foregoing, which is reliable and effective in its operation, functioning to prevent unauthorized refilling of the bottles with which it is used.

A feature of the invention is the provision of a stopper plug as above detailed, which can be economically molded in one quick operation and then further assembled in the simplest possible manner and with the least amount of skill, even by a handicapped or blind person.

Still other features and advantages will hereinafter appear.

In accomplishing the above objects the invention provides a stopper plug comprising a one-piece, resilient plastic molding in the form of two mating halves which are joined to each other by an integral living hinge. Each half is constituted of a semi-cylindrical wall, having at its ends two transverse walls. The semi-cylindrical walls and the transverse walls respectively are arranged to have planar portions which lie in flat planes and are adapted for engagement with corresponding portions when the halves are folded together. In this way, the halves when assembled form a complete cylinder. The living hinge connects together the planar edge portions of two of the transverse end walls, one from each half. The mating halves provide a channel therethrough when they are folded to form the complete cylinder. In the channel there is provided a back-check valve means which includes portions of the said halves, such valve means being operable to limit flow of liquid through the channel in one direction. In the channel, baffles or partitions extend to prevent the insertion of a tool or wire for the purpose of interfering with the stop-action of the valve means. The baffles are in the form of integral walls molded as parts of the mating halves, and the transverse walls connected to the living hinge likewise function as effective baffles. Some of the baffles are shaped so as to nest the valve, which is in the form of a ball, when the stopper plug is permitting the pouring-out of the liquid.

In the accompanying drawings, illustrating a preferred embodiment of the invention:

Figure 1:
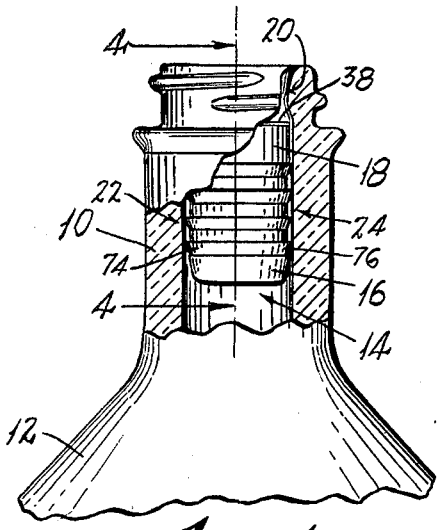
FIG. 1 is a view of the neck portion of a bottle, shown partially in side elevation and partially in axial section, and showing in side elevation the one-way stopper plug of the invention.

As shown, the improved one-way stopper plug as provided by the present invention is insertable in the neck portion 10 of a bottle or jug 12. The plug, designated generally by the numeral 14, has a slightly tapered end portion 16 which is the portion inserted first into the bottle neck. The other end portion 18 is not so tapered, and thus one can tell by the feel which is the proper end to place first into the neck. Unskilled help, and even a blind person could thus assemble the plug properly into the bottle.

Glass bottles generally have constrictions or chokes in the neck portions thereof, such a choke being shown and designated 20 in the figures. The choke 20 can be readily bypassed during the insertion of the plug 14 due to the resiliency of the plastic substance from which the plug is molded, and since considerable pressure can be exerted on the plug, if necessary, to insert the same.

The choke 20 in the bottle neck is useful in preventing unauthorized removal of the plug 14 from the neck, and normally such removal presents difficulties to the average user, discouraging any efforts to take the plug out for the purpose of refilling the bottle.

Figure 2:
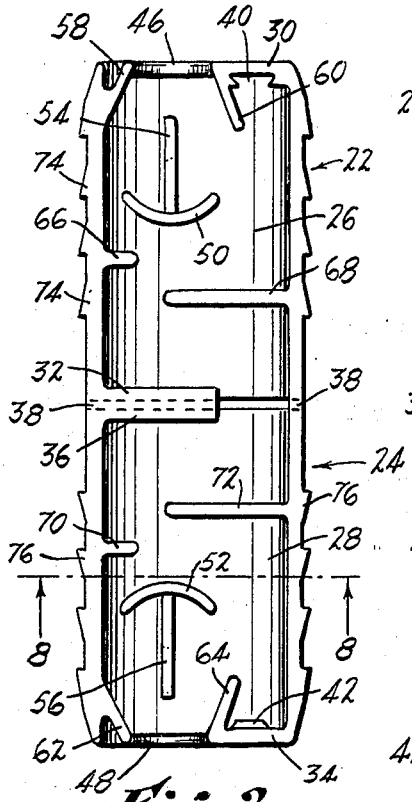
FIG. 2 is a plan view of the molded piece as it is removed from the mold, showing the two mating halves and the integral living hinge by which they are connected.
Figure 3:
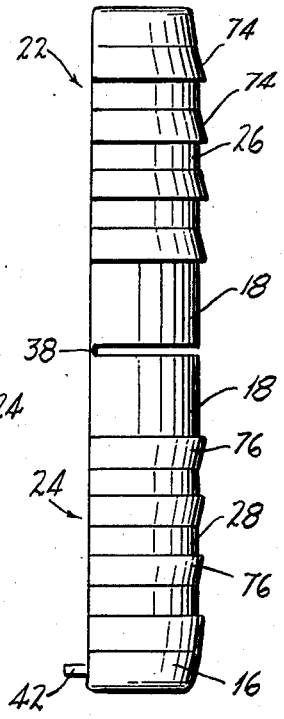
FIG. 3 is a side elevational view of the molded piece of FIG. 2.

As seen in FIGS. 2 and 3, the plug 14 is molded in a single operation as a single piece of plastic, this being possible due to the arrangement of two mating halves of the plug, which are mirror images of each other, and a connecting living hinge. In these figures, the upper plug half is designated 22 and the lower plug half 24. The plug halves 22, 24 are respectively constituted of semi-cylindrical walls 26 and 28 having at their ends, pairs of transverse walls 30, 32 and 34, 36 respectively.

According to the invention, the two transverse walls 32 and 36 are connected together by an integral or living hinge 38, whereby the mating halves 22, 24 are joined in the proper orientation for folding one on the other so as to form a complete cylinder. Such complete cylinder is as designated in FIG. 1 by the numeral 14.

The longitudinal edges of the semi-cylindrical portions 26, 28 are molded to lie in a common flat plane, which also contains the corresponding edges of the end walls 30, 32, 34 and 36. This is clearly shown in FIGS. 2 and 3. The living hinge 38 also lies in the same plane as the said edges. Considering FIG. 3, the top mating half 22 of the stopper plug can be folded to the left and downward, about the hinge 38, so that it comes directly opposite the lower mating half 24, thereby to form a complete cylinder exactly as shown in FIG. 1.

In accordance with the invention, registering means are provided on the halves 22 and 24, which are cooperable to effect an exact registration of the same. The half 22 has a recess 40 of dove-tail configuration, and the mating half 24 has a projection or lug 42 of similar configuration, adapted to be received in the recess 40. This, together with the living hinge 38, accurately positions the mating halves, since the positioning is effected at both of the two ends of each half.

The hollow configuration of the mating halves provides a channel therethrough, for the passage of the liquid from the interior of the bottle 12. Disposed in the said channel is a back-check means in the form of a ball 44, FIGS. 4 and 5, which can advantageously be constituted of stainless steel which is chemically inert and has appreciable weight. The walls 30 and 34 have semi-circular openings 46 and 48 respectively which together form a completely circular opening when the halves 22 and 24 are folded together. This circular opening constitutes a valve seat for the ball valve 44, as can now be understood. When the ball is so seated, it closes the passageway through the plug 14, this being shown in FIG. 4 where is the bottle is in the upright position. In this case, refilling is prevented.

Figure 5:
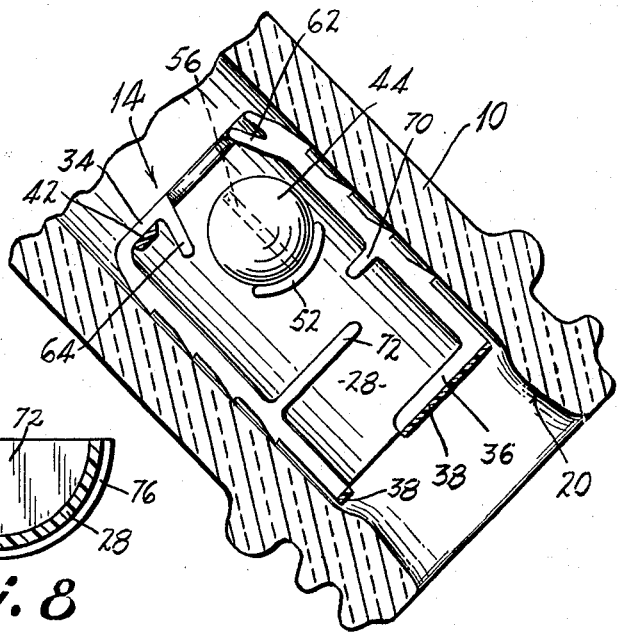
FIG. 5 is a view similar to that of FIG. 4 but showing the tilted position of the bottle neck and stopper plug, wherein pouring out of the contents of the bottle can take place.
Figure 6:
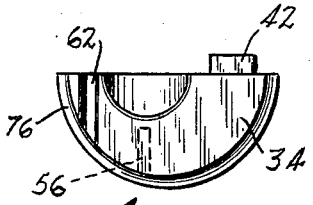
FIG. 6 is an interior end elevational view of the stopper plug half seen in FIG. 4, but with the ball valve removed.
Figure 8:
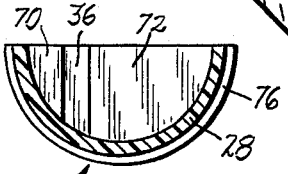
FIG. 8 is a transverse section, taken on the line 8—8 of FIG. 2.
Figure 7:
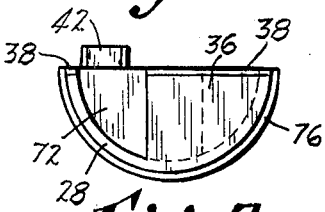
FIG. 7 is an outer end elevational view of the stopper plug half seen in FIG. 4, but with the ball valve removed.
Figure 9:
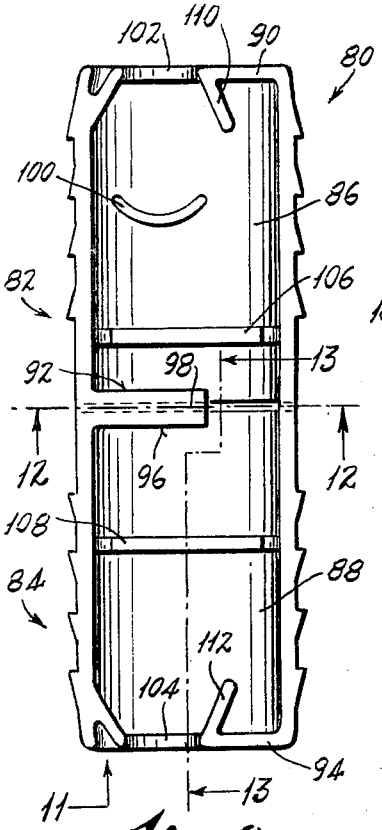
FIG. 9 is a plan view like that of FIG. 2 but showing a different embodiment of the invention.
Figure 10:
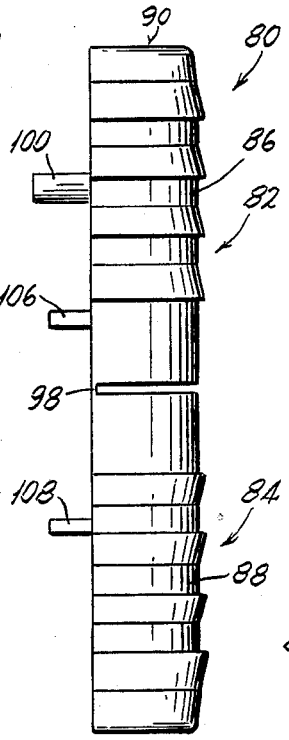
FIG. 10 is a view like that of FIG. 3, showing a side elevational view of the stopper plug molding of FIG. 9.
Figure 13:
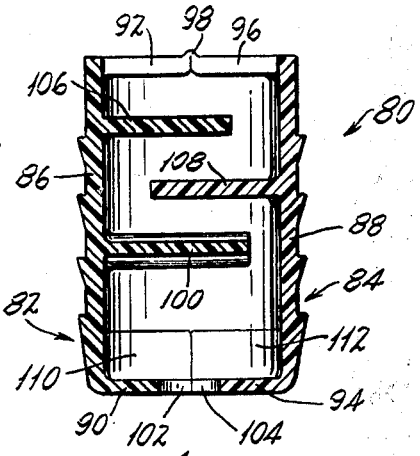
FIG. 13 is a longitudinal section, taken on the line 13—13 of FIG. 9.
Figure 11:
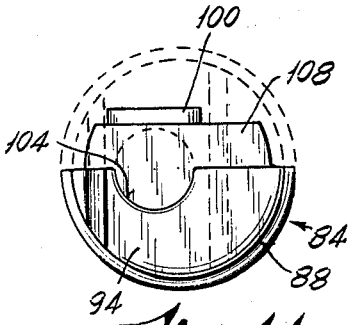
FIG. 11 is an end elevational view of the molding of FIG. 9, looking in the direction of the arrow 11.
Figure 12:
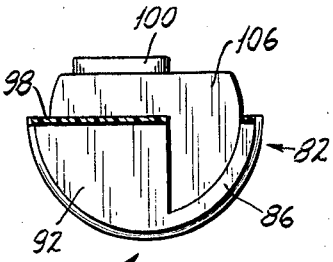
FIG. 12 is a transverse section, taken on the line 12—12 of FIG. 9.

In accordance with the invention, a novel cradle or seat is provided to nest the ball for the pouring position of FIG. 5. This seat comprises baffle walls 50, 52 in the mating halves 22, 24—such walls having a curved configuration as shown. In addition, ribs 54 and 56 are provided, to centralize the valve ball 44. Also, walls 58, 60, 62 and 64 are provided respectively in the mating halves 22 and 24, to cradle the ball valve into the valve seat in the walls 30, 34.

The invention further provides, for additional insurance against tampering, baffle walls 66, 68, 70 and 72 respectively in the mating halves 22, 24. These become respectively registered when the halves are folded, and constitute effective means for obstructing a tool, wire etc. from reaching the ball valve 44. The corresponding edges of all the baffle walls lie in the same common, flat plane mentioned above, as can be understood.

The end walls 32, 36 which have the living hinge 38 also constitute an effective baffle means. By virtue of the staggered disposition of the baffle walls designated above, a tortuous passage is provided for the stream of liquid from the bottle, but nevertheless an adequate one while at the same time the ball check is effective in limiting reverse flow or filling of the bottle.

According to the invention, each mating half is provided with a plurality of friction shoulers of semi-circular form, designated respectively 74 and 76, which are adapted to engage the interior surface of the bottle neck with a tight fit when the halves are folded into a complete cylinder. This will prevent pull-out of the plug under normal circumstances. The tight fit of the plug holds the mating halves 22, 24 securely in assembled relation, as can be understood.

From the foregoing it will be seen that I have provided a novel and unique one-way stopper plug for bottles and the like, which will effectively prevent refilling by unauthorized persons.

Another embodiment of the invention is illustrated in FIGS. 9–13. In these figures the plug 80 comprises a single piece of plastic, molded with two mating halves 82 and 84 having semi-cylindrical walls 86 and 88 respectively. At their ends, the walls 86 and 88 have pairs of transverse walls 90, 92 and 94, 96 respectively.

The transverse walls 92 and 96 are connected together by an integral or living hinge 98 in a manner that the mating halves 92, 94 are properly oriented for folding one on the other so as to form a complete cylinder. Such cylinder is depicted by the combined full circular and dotted circular lines in FIG. 11, for example.

Figure 4:
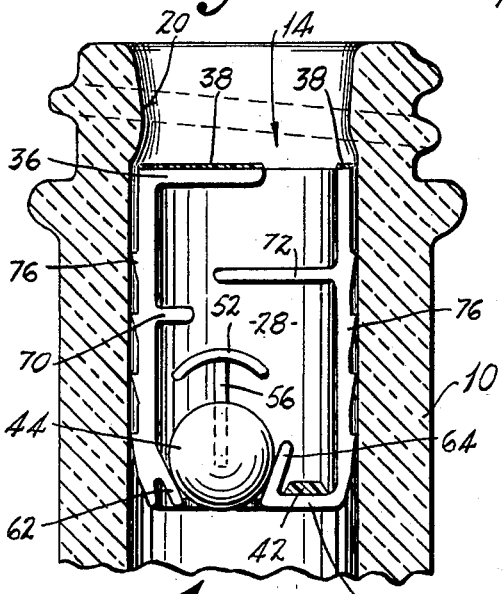
FIG. 4 is an axial sectional view, enlarged, of the bottle neck and the assembled stopper plug. The section taken through the plug cuts through the living hinge thereof; the valve is closed.

The molding half 82 has a cradle 100 to nest a ball valve such as the valve 44 shown in FIGS. 4 and 5, and the walls 90 and 94 have semi-circular openings 102 and 104 respectively, to constitute a valve seat for the ball valve 44 when the halves 82 and 84 are folded together. The molded plug half 82 has a partially circular baffle 106, and the molded half 84 has a partially circular baffle 108.

Walls 110 and 112 in the halves 82, 84 cooperate to help cradle the ball valve 44 in the seat comprising the openings 102, 104 in the walls 90, 94.

The embodiment of FIGS. 9–13 represents a simpler molded part, and the structure and arrangement of the baffles 92, 96 100, 106 and 108 make it extremely difficult to dislodge the ball 44 from its seat by the use of an inserted wire, applied to the mouth of a bottle in which the plug is installed.

The plugs shown are especially economical to produce, have a low assembly labor cost, contain very few parts, and are capable of being handled by unskilled labor, handicapped people, blind persons and the like in assembling and installing them.

Variations and modifications are possible without departing from the spirit of the claims.

I claim:

1. A one-way stopper plug for bottles and the like, to permit pouring out of the liquid content of a bottle while preventing refilling of the bottle, comprising in combination:

(a) a one-piece, resilient plastic molding comprising mating halves joined to each other by an integral living hinge, (b) each half being constituted of a semi-cylindrical wall having at its ends two transverse walls, all walls being integral, (c) said semi-cylindrical wall and transverse walls of each said one half having planar edge portions lying in a flat plane and being adapted for engagement with corresponding edge portions of the other half, thereby to form a complete cylinder, (d) said living hinge connecting together the planar edge portions of two of the said integral walls, one from each of said halves, (e) said mating halves providing a channel therethrough when they form a complete cylinder, and (f) back-check valve means including portions of said halves, operable to limit flow of liquid through said channel in one direction.

2. A one-way stopper plug for bottles, as defined in claim 1, wherein:

(a) each of said mating halves has a plurality of transverse baffle walls, (b) corresponding baffle walls of said halves mating with each other when the halves are assembled to form said cylinder, whereby obstruction is provided between said valve means and the discharge end of the cylinder.

3. A one-way stopper plug for bottles, as defined in claim 2, wherein:

(a) said back-check valve means comprises a ball member, (b) a pair of said baffle walls being shaped to nest said ball member for the non-checking position of the latter.

4. A one-way stopper plug for bottles, as defined in claim 1, wherein:

(a) said mating halves have centering ribs adapted for disposition on opposite sides of the back-check valve means to hold the latter centralized when the mating halves are assembled to form the complete cylinder.

5. A one-way stopper plug for bottles, as defined in claim 1, wherein:

(a) said mating halves have cooperable registering means, to effect a registration of the halves when they are assembled to form the complete cylinder.

6. A one-way stopper plug for bottles, as defined in claim 5, wherein:

(a) said cooperable registering means comprises a recess in one transverse end wall of one mating half, and a projection on one transverse end wall of the other mating half.

7. A one-way stopper plug for bottles, as defined in claim 6, wherein:

(a) the end walls which carry the cooperable registering means are remote from said living hinge.

8. A one-way stopper plug for bottles, as defined in claim 1, wherein:

(a) the said two integral walls which carry the living hinge are end walls and constitute an obstruction between the back-check valve means and the discharge end of the complete cylinder.

9. A one-way stopper plug for bottles, as defined in claim 1, and further including:

(a) friction shoulders on the exterior surfaces of the mating halves, for engagement with the interior neck surfaces of a bottle to effect a tight fit between the bottle and the complete cylinder and prevent pull-out of the cylinder.

* * * * *